US005836557A

United States Patent [19]

Bailey et al.

[11] Patent Number: 5,836,557

[45] Date of Patent: Nov. 17, 1998

[54] DETACHABLE UTILITY TRAY FOR STEP LADDER

[76] Inventors: Harold David Bailey, 407 Ross St.; Keith Alan Bailey, 408 Eastline Dr., both of Middletown, Ohio 45044

[21] Appl. No.: 801,023

[22] Filed: Feb. 19, 1997

[51] Int. Cl.[6] ..... E06C 7/14

[52] U.S. Cl. ..... 248/210; 248/274.1; 248/231.41; 248/903; 182/129

[58] Field of Search ..... 248/210, 238, 248/226.11, 228.3, 228.8, 228.5, 228.1, 903, 227.2, 231.61, 231.41, 231.85, 211, 682, 300, 274.1; 182/120, 129; 211/70.6; D3/304, 305, 307, 308, 309

[56] References Cited

U.S. PATENT DOCUMENTS

| | | | |
|---|---|---|---|
| D. 321,371 | 11/1991 | Galante . | |
| 2,541,434 | 2/1951 | Nelson et al. | 248/210 |
| 2,694,825 | 11/1954 | Touchett et al. | 248/211 X |
| 2,899,011 | 8/1959 | Babits | 182/120 |
| 4,042,201 | 8/1977 | O'Callaghan | 248/300 X |
| 4,141,524 | 2/1979 | Corvese, Jr. | 248/231.41 X |
| 4,480,810 | 11/1984 | Hall | 248/238 |
| 5,333,823 | 8/1994 | Joseph | 248/210 X |
| 5,584,357 | 12/1996 | Gugel et al. | 182/129 |
| 5,603,405 | 2/1997 | Smith | 248/210 X |
| 5,624,093 | 4/1997 | Gemmell | 248/210 X |
| 5,649,623 | 7/1997 | Kornblatt | 248/210 X |
| 5,687,941 | 11/1997 | Quintile | 248/210 |

FOREIGN PATENT DOCUMENTS

| | | | |
|---|---|---|---|
| 384017 | 12/1932 | United Kingdom | 248/231.61 |

*Primary Examiner*—Ramon O. Ramirez
*Assistant Examiner*—Stephen S. Wentsler
*Attorney, Agent, or Firm*—Jack C. McGowan

[57] ABSTRACT

The invention is a utility tray assembly that is capable of being mounted on a support member of a ladder, such as a shelf or a step. The assembly includes a tray having parallel side walls, parallel end walls disposed normal to the side walls, and a bottom defining a plane and disposed normal to the side walls and the end walls. The end walls have slots therein extending in a direction parallel to the plane of the bottom. The assembly further includes a strap having a body portion and opposing end portions. Each of the end portions includes a slot extending in a direction parallel with the longitudinal axis of the strap. A fastener is associated with each end wall and is insertable through the slots in the end wall and the strap for securing the end portions of the strap to the tray end walls in such a manner that the support member of the ladder is captured between the body portion of the strap and the undersurface of the tray bottom.

6 Claims, 2 Drawing Sheets

DETACHABLE UTILITY TRAY FOR STEP LADDER

BACKGROUND OF THE INVENTION

1. Field of the Invention

The present invention relates to trays for ladders and the like, and more particularly to a portable utility tray and a strap that can be adjustably attached to the tray and used to clamp the tray to a shelf on a step ladder.

2. Description of the Related Art

Typically, persons who use step ladders or extension ladders have difficulty storing and/or handling items they require for completing the tasks they set out to accomplish. The difficulty arises when there is a need for a particular tool that the person cannot carry on his person, and multiple trips up and down the ladders are necessary to retrieve or replace the requisite implements.

The prior art is replete with examples of assemblies for adjustably mounting containers on ladder shelves or steps. One class of assembly is used to secure paint containers on the shelving or step (see U.S. Pat. No. 2,308,180 (a strap), U.S. Pat. No. 2541434 (suspension) and U.S. Pat. No. 3961766 (a clamp)).

A second class of assembly is used to secure trays or containers on the shelving or steps of the ladders. Examples of such assemblies can be found in U.S. Pat. Nos. 5,333,823 to Joseph, 4,949,925 to Gorecki, 4,480,810 to Hall.

All of these prior art assemblies are complicated in structure and require much time and dexterity to tighten the fastening mechanisms so that the trays or containers can be secured on the step or platform.

Against this background, the applicants have developed a novel utility tray construction which includes a strap adjustably attachable to elongated openings in ends of the tray and capable of securing the tray to a step or shelf on a ladder by capturing and tightly holding the step or shelf between the strap and the underside of the tray.

OBJECTS AND SUMMARY OF THE INVENTION

It is therefore an object of the present invention to provide a novel utility tray which can quickly and easily be secured to a shelf or step of a ladder, while overcoming many of the drawbacks and disadvantages of the prior art.

Another object of the present invention is to provide a tray assembly which includes a shelf-attaching strap that is adjustable to accommodate different thickness shelves or steps.

Still another object of the invention is to provide a utility tray and shelf attaching strap where the strap can be adjusted horizontally to allow the tray to be located at different positions on a ladder shelf or step, as well as vertically to accommodate shelves or steps of differing thicknesses.

These and other objects and advantages are attained through the tray and strap of the present invention in accordance with the construction as described below.

DETAILED DESCRIPTION OF THE INVENTION

Figure 1:
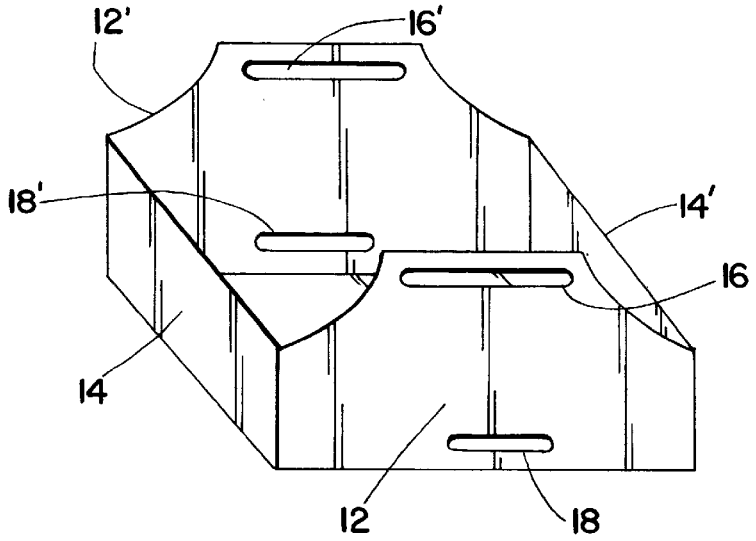
FIG. 1 is a perspective view of one configuration of a tray embodying the structural features of the present invention.
Figure 2:
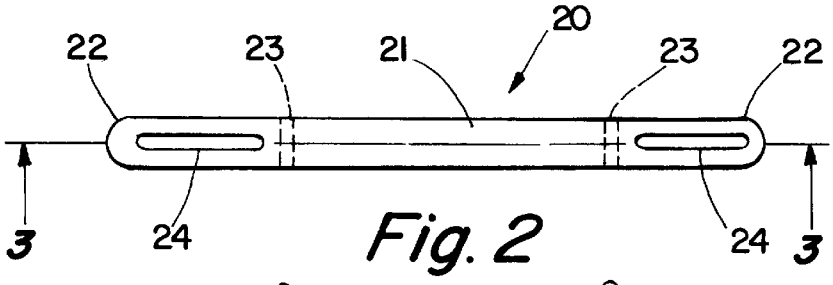
FIG. 2 is a top view of a strap to be used with the tray shown in FIG. 1 for holding the tray on a step or shelf of a ladder as shown in FIG. 7.
Figure 3:
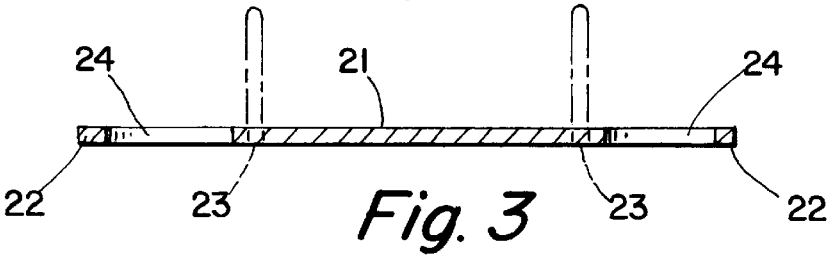
FIG. 3 is a cross-sectional side view of the strap of FIG. 2, the view being taken along section lines 3—3 shown in FIG. 2.

Referring now to FIGS. 1–3, there is shown a utility tray of the type contemplated for use by the present invention. The tray includes end walls 12, 12', side walls 14, 14', and a bottom or floor 15. The floor of the tray is preferably rectangular, and is arranged substantially normal to the side and end walls. Each of the end walls includes a slot 18, 18' located substantially centrally thereof. The slots extend in a direction that is substantially parallel with the plane of the tray floor 15.

The upper portions of the end walls 12, 12 may be of the same height as the height of the side walls, or they may be of greater height as shown in FIG. 1, in which case the upper region of each end wall will preferably be provided with a slot 16, 16'. Each slot extends preferably in a direction that is parallel with the plane of the tray floor, and functions as finger grips to allow a user to grasp the tray for transporting it from one place to another.

FIG. 2 shows a preferred embodiment of a strap 20 used with the tray of the present invention. The strap includes a body portion 21 and two end portions 22, 22. Fold lines 23, 23 separate the body portion from the end portions. Disposed in each of the end portions are slots 24, 24. The slots have a length which extends along the longitudinal axis of the strap. FIG. 3 is a cross-sectional view of the strap shown in FIG. 2 taken along the section lines 3—3 in FIG. 2. FIG. 3 shows end portions 22, 22 turned 90° upwardly so as to extend normal to the body portion 21 of the strap. The purpose of these end portions will be described below in connection with the manner in which the strap is used with the tray.

Figure 4:
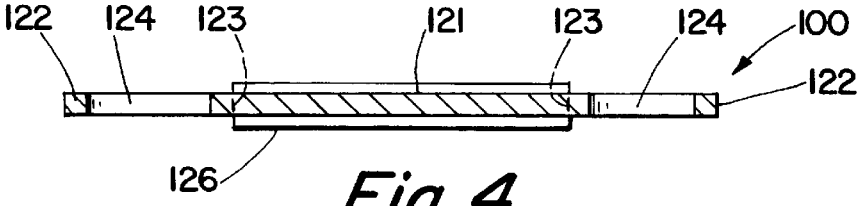
FIG. 4 is a cross-sectional side view of a strap showing reinforcing members on the underside of the strap.
Figure 5:
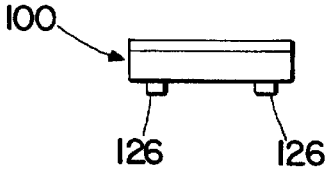
FIG. 5 is an end view of the strap shown in FIG. 4.
Figure 6:
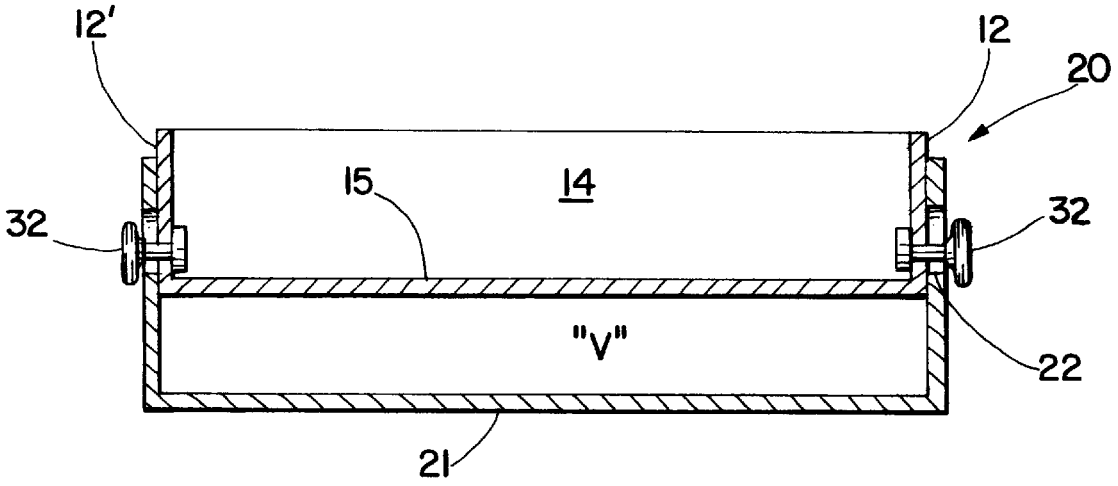
FIG. 6 is a sectional view of the tray showing the strap mounted thereon.
Figure 7:
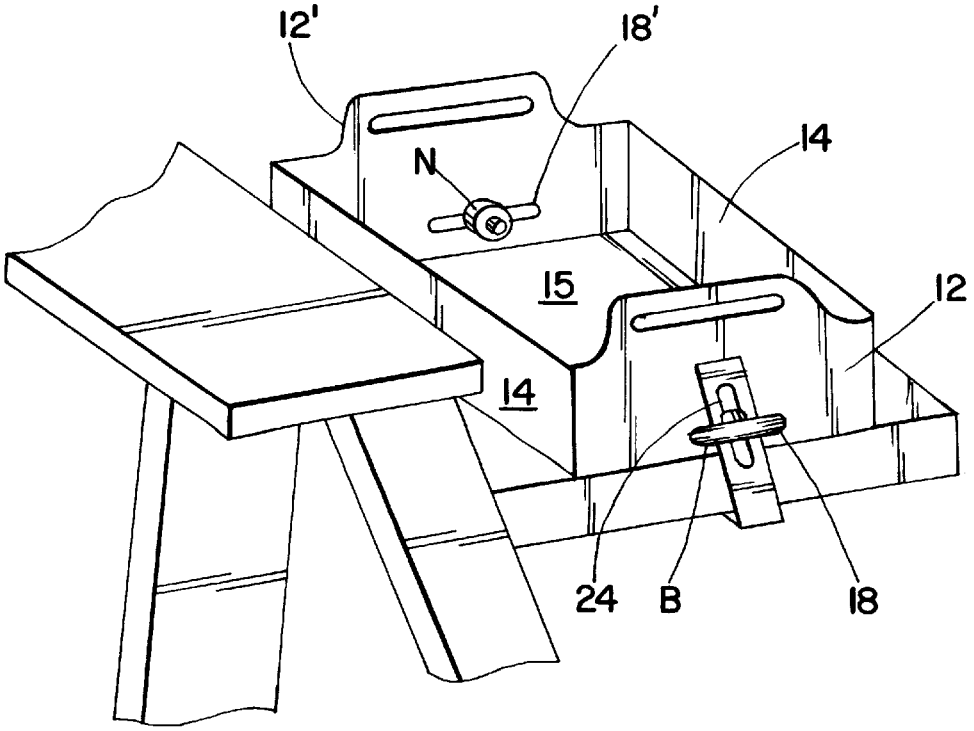
FIG. 7, is a perspective view of the tray secured to a shelf or step of a ladder by a strap.

FIGS. 4 and 5 show a second embodiment of strap 100 which is essentially identical to the strap shown in FIGS. 2 and 3 with the exception of the reinforcing members 126, 126 that extend along the longitudinal axis of the strap. These reinforcing members 126, 126 are disposed on opposite sides of the longitudinal axis of the strap, and impart an extra degree of rigidity to the strap, especially where the strap is constructed of plastic. FIGS. 6 and 7 show the manner in which a strap is attached to the tray. As shown, the strap is used with the end portions folded at 90° to the body portion (as shown in FIG. 3 in phantom lines). The end portions of the strap are then placed adjacent the end walls of the tray with the openings 24, 24 adjacent the slots 18, 18. A fastener 32 is inserted through the slot in the end portion of the strap and the end wall, and is secured on the inside of the tray. Preferably, the fastener comprises a threaded shank with a head, such as a bolt B, and a threaded nut N. The strap, secured to the tray in this manner, will describe a volume "V" between its upper surface and the lower surface of the tray floor 15. In this volume, the thickness of a ladder shelf or step is tightly captured and secured. Volume "V" is adjustable insofar as it can be made smaller or larger by virtue of the ability to raise or lower the body of the strap relative to the underside of the tray floor. In addition, because the slots 18 are elongated in a direction that is parallel with the tray floor, the strap may be positioned to one side or the other of the tray when it is desired to position the tray on a shelf or step that is narrower or longer than another shelf or step. Thus, the position of the strap relative to the end walls may be changed to accommodate different thicknesses, as well as different lengths, of shelves or steps.

While the present invention has been described in conjunction with specific embodiments thereof, it is evident that many alternatives, modifications, and variations will be apparent to those skilled in the art in light of the foregoing description. Accordingly, the present invention is intended to embrace all alternatives, modifications, and variations which fall within the spirit and scope of the appended claims.

What I claim is:

1. A utility tray assembly capable of being mounted on a support member of a ladder, such as a shelf or step, comprising:

a tray including parallel side walls, parallel end walls disposed normal to said side walls, and a bottom defining a plane and disposed normal to said side walls and said end walls, each of said end walls having a first slot therein extending in a direction parallel to the plane of said tray bottom, said tray bottom having an undersurface;

a strap having a body portion and opposing end portions situated along a longitudinal axis, each of said end portions including a slot therein extending in a direction parallel with said longitudinal axis of said strap, and a fastener associated with each of said end walls and insertable through said slots in said end walls and said strap for securing said end portions of said strap to said tray end walls in such a manner that the support member of said ladder is captured between the body portion of said strap and said undersurface of said tray bottom.

2. The utility tray assembly of claim 1, wherein said end wall slots and said strap slots are configured to permit adjustment of said strap relative to said end walls in a direction extending parallel to the plane of said tray bottom as well as in a direction normal to the plane of said tray bottom.

3. The utility tray assembly of claim 1, wherein each of said end walls further include a second slot which is arranged parallel to said first slot, said second slot being spaced from said first slot to allow a user to insert his fingers and grasp the end walls.

4. The utility tray assembly of claim 3, wherein each said second slot is located in an upper portion of a respective one of said end walls.

5. The utility tray assembly of claim 1, wherein said strap further includes parallel reinforcing members extending along said longitudinal axis of said strap.

6. The utility tray assembly of claim 5, wherein said reinforcing members are disposed on opposite sides of said strap.

* * * * *